United States Patent [19]

Honda

[11] Patent Number: 4,960,186

[45] Date of Patent: Oct. 2, 1990

[54] ELEVATOR HOIST APPARATUS WITH AN OUTER ROTOR MOTOR

[75] Inventor: Takenobu Honda, Inazawa, Japan

[73] Assignee: Mitsubishi Denki Kabushiki Kaisha, Japan

[21] Appl. No.: 298,949

[22] Filed: Jan. 19, 1989

[30] Foreign Application Priority Data

Jan. 21, 1988 [JP] Japan ..... 63-11405

[51] Int. Cl.[5] ..... B66B 11/04

[52] U.S. Cl. ..... 187/20; 254/362; 310/105

[58] Field of Search ..... 187/17, 20, 27; 254/362; 242/155 R; 310/103, 105

[56] References Cited

U.S. PATENT DOCUMENTS 1,237,321 8/1917 Fraser ..... 187/20
4,355,785 10/1982 Tosato et al. ..... 187/20

FOREIGN PATENT DOCUMENTS 598405 3/1934 Fed. Rep. of Germany ..... 187/20
607303 12/1934 Fed. Rep. of Germany ..... 187/20
1379449 11/1963 France ..... 187/20
52-32870 3/1977 Japan .
59-118686 7/1984 Japan .
61-295982 12/1986 Japan .
62-222991 9/1987 Japan .
63-351 1/1988 Japan .

*Primary Examiner*—H. Grant Skaggs
*Assistant Examiner*—Kenneth Noland
*Attorney, Agent, or Firm*—Leydig, Voit & Mayer

[57] ABSTRACT

An elevator hoist apparatus with an outer rotor motor includes a support structure, a sheave rotatably mounted on the support structure, and an electric motor mounted on the support structure for driving the sheave. The motor includes a stator fixedly mounted on the support structure, a motor frame mounted only to the sheave for rotation therewith, and a rotor mounted to the frame in an electromagnetically inductive relationship with the stator. The support structure comprises a pair of pedestals and an elongated support member supported at its opposite ends by the pedestals for supporting the sheave and the stator.

3 Claims, 1 Drawing Sheet

ELEVATOR HOIST APPARATUS WITH AN OUTER ROTOR MOTOR

BACKGROUND OF THE INVENTION

This invention relates to an elevator hoist apparatus and, more particularly, to a gearless traction-type elevator hoist apparatus in which an elevator car and a counter weight are driven through main ropes by an outer rotor motor.

FIG. 1 illustrates in a schematic sectional diagram an elevator system in which the conventional traction-type gearless elevator hoist apparatus with an outer rotor motor is employed. It is seen that the elevator system is installed in a building B defining a hoistway H and a penthouse P having a floor F. An elevator hoist apparatus is installed on the floor F of the penthouse P. The conventional hoist apparatus comprises a support structure having a pair of pedestals 1 extending upwardly from the floor F and an elongated support member 2 which may be a cylindrical shaft fixedly supported at its opposite ends by the pedestals 1. The support shaft 2 has securely mounted on its center portion a motor stator 3 including an iron core 3*a* and a coil 3*b*. A drum-shaped sheave 4 having a cylindrical wall 4*a* on which grooves 4*d* are formed and a pair of substantially annular disc-shaped plates 4*b* is rotatably mounted on the stationary support shaft 2 by bearings 4*c*. It is seen that the cylindrical wall 4*a* of the sheave 4 has on its inner surface a motor rotor 5 including a plurality of iron cores. Thus, the stator 3 on the support shaft 2 and the rotor 5 rotatably supported by the sheave 4 around the stator 3 constitute a three-phase induction motor which can be controlled by voltage regulation or frequency regulation. This motor is an outer rotor motor because the rotor is disposed outside of the stator to rotate around the stator.

Three main ropes 7 are placed within the grooves 4*d* and wound around the sheave 4. The ropes 7 have at the one end thereof an elevator car 8 and at the other end therof a counter weight 9. A brake mechanism 6 is mounted on the pedestals 1 so that it can apply a braking force on the drumshaped sheave 4.

With the elevator hoist apparatus as above described, the diameter of the sheave 4 is determined by the diameter of the rotor iron core 5 which depends on the electrical characteristics of the motor. Therefore, the load torque with respect to the motor become large, making the diameter of the sheave 4 unneccessarily large.

Also, since the loads of the elevator car 8 and the counter weight 9 applied on the sheave 4 must be supported by two disc-shaped side plates 4*b*, the side plates 4*b* as well as the cylindrical wall 4*a* of the sheave 4 must be made strong enough to support the load, resulting in a heavy rotating structure. Since the rotary portion is heavy, the support shaft 2 and the pedestals 1 therefor must also be strong and heavy. It is desirable to decrease the unneccessary weight of the hoist apparatus.

Further, when the load acting on the sheav 4 through the main ropes 7 changes, the dimension of the air gap between the stator 3 and the rotor 5 of the induction motor changes, so that the operation of the motor varies to such an extent that the comfortable ride in the elevator car is not realized.

SUMMARY OF THE INVENTION

Accordingly, one object of the present invention is to provide an elevator gearless hoist apparatus with an outer rotor motor free from the above-discussed disadvantages of the conventional elevator hoist apparatus.

Another object of the invention is to provide an elevator gearless hoist apparatus with an outer rotor motor having a sheave of which outer diameter can be selected independently of the rotar diameter.

Another object of the present invention is to provide an elevator hoist apparatus with an outer rotor motor of a small size.

Still another object of the present invention is to provide an elevator gearless hoist apparatus with an outer rotor motor of light weight.

Further object of the present invention is to provide an elevator gearless hoist apparatus with an outer rotor motor in which the operational characteristics are not changed even when the load on the main ropes varies.

Another object of the present invention is to provide an elevator hoist apparatus with an outer rotor motor in which the elevator car travels smoothly.

With the above objects in view the elevator hoist apparatus with an outer rotor motor of the present invention comprises a support structure, a sheave rotatably mounted on the support structure, and an electric motor mounted on the support structure for driving the sheave. The outer rotor motor comprises a stator fixedly mounted on the support structure, a motor frame having a sheave mounted only to one side of the frame, and a rotor mounted to the frame in an electromagnetically inductive relationship with the stator. The support structure comprises a pair of pedestals and an elongated support member supported at its opposite ends by the pedestals for supporting the sheave and the stator.

BRIEF DESCRIPTION OF THE DRAWING

The present invention will become more readily apparent from the following detailed description of the preferred embodiment of the present invention taken in conjunction with the accompanying drawings, in which.

DESCRIPTION OF THE PREFERRED EMBODIMENT

Figure 1:
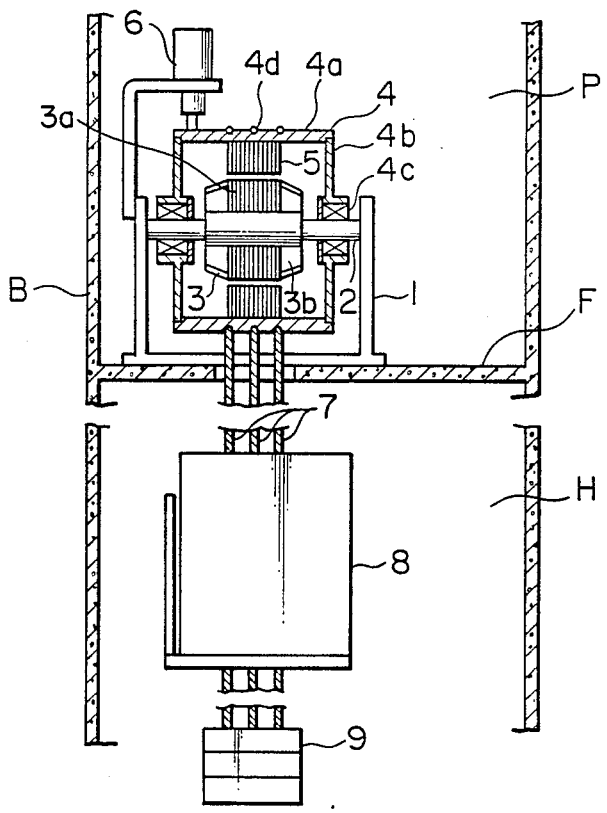
FIG. 1 PRIOR ART
FIG. 1 is a schematic sectional view of an elevator system employing a conventional hoist apparatus with an outer rotor motor.
Figure 2:
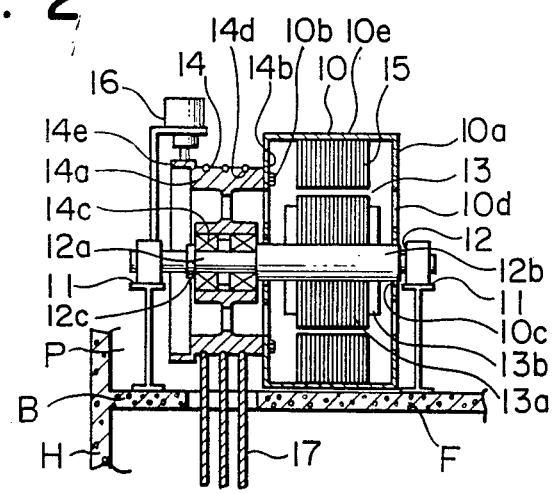
FIG. 2 is a schematic sectional view of an elevator hoist apparatus with an outer rotor motor according to the present invention.

FIG. 2 illustrates, in a schematic sectional diagram, a traction-type gearless elevator hoist apparatus with an outer rotor motor constructed in accordance with the present invention. It is seen that the elevator hoist apparatus is installed on a floor F of a penthouse P above a hoistway H. The hoist apparatus comprises a support structure S having a pair of pedestrals 11 secured and extending upwardly from the floor F and a horizontal, elongted support member 12 which may be a cylindrical shaft fixedly supported at its opposite ends by the pedestals 11. The support shaft 12 has a small-diameter portion 12*a* and a large-diameter portion 12*b* with a step therebetween. It is seen that an outer rotor motor assembly is disposed on the large-diameter portion 12*b* of the support shaft 12, and a sheave assembly 14 is disposed on the small-diameter portion 12*a* of the support shaft 12. The support shaft 12 has securely mounted on its large-diameter portion 12*b* a cylindrical motor stator 13 including an iron core 13*a* and a coil 13*b*. It is also seen that a sheave 14 having a cylindrical wall 14*a* on which grooves 14*d* are formed and a pair of substantially annular sides 14*b* are rotatably mounted on the stationary support shaft 12 by bearings 14*c* fitted on the small-diameter portion 12*a*. The bearings 14*c* are mounted between the step between the small-diameter portion 12*a* and the large-diameter portion 12*b* of the support shaft 12 and a stop ring 12*c* secured on the support shaft small-diameter portion 12*a*. The sheave 14 is provided at one edge or side 14*b* (left side in FIG. 2) of the cylindrical wall 14*a* with a brake drum 14*e*.

On the other edges or the annular sides 14*b* (right side in FIG. 2) of the cylindrical wall 14*a* of the sheave 14, a motor frame 10 is securely mounted for rotation therewith. The motor frame 10 commprises a pair of substantially annular, radially-extending disc-shaped plates 10*a* and a substantially cylindrical wall 10*e* axially extending from the annular plates 10*a* to surround the motor stator 13. The motor frame 10 is secured to the sheave 14 at one of its side annular plataes 10*a* by a suitable securing means such as bolts 10*b*. The annular plates 10*a* have openings 10*d* for allowing cooling air to flow therethrough. The side plates 10*a* have an inner edge 10*c* which does not serve to support any load against the support shaft 12. In the illustrated embodiment, the inner edge 10*c* is not in contact with nor rotatably supported by the support shaft 12. Thus, the motor frame 10 is supported only by the sheave 14 so that it is rotatable relative to the support shaft 12. The cylindrical wall 10 has an inner cylindrical surface 10*e* on which a motor rotor 15 including a plurality of iron cores is attached. Thus, the stator 13 on the support shaft 12 and the rotor 15 disposed around the stator 13 and attached to the motor frame 14 which in turn is supported by the sheave 14 rotatably supported on the support shaft 12 constitutes a three-phase induction motor which can be controlled by voltage regulation or frequency regulation. Again, since the rotor 15 surrounds the stator 13, this motor is an outer rotor motors.

Three main ropes 17 are placed within the grooves 14*d* and wound around the sheave 14. Although not illustrated, the main ropes 17 have connected at one end thereof an elevator car and at the other end thereof a counter weight. A brake mechanism 16 is mounted on the pedestral 11 so that it can apply a braking force on the brake drum 14*e* of the sheave 14.

With the elevator hoist apparatus of the present invention as above described, the diameter of the sheave 14 can be determined only in accordance with the load torque on the sheave 14 independently of the diameter of the rotor iron core 15 which depends on the electrical characteristics of the motor. Therefore, the load torque on the motor can be selected to be within a reasonable range in order not to make the diameter of the sheave 14 unnecessarily large.

Also, since the loads of the elevator car and the counter weight applied on the sheave 14 are directly supported by the support shaft 12, the motor frame 10 needs only to properly support rotor 15, making the motor frame significantly light-weight as compared to the conventional design.

Further, even when the load acting on the sheave 14 through the main rope 17 changes, the dimensional change of the air gap between the stator 13 and the rotor 15 of the outer-rotor induction motor is significantly reduced because the load does not act directly on the motor frame 10 supporting the rotor 15, so that a comfortable ride in the elevator car can be realized.

Also, since the width of the sheave 14 is narrow as compared to that of the conventional design, the support shaft 12 does not have to be precision-postioned with respect to the pedestals 11, so that the installation of the hoist apparatus is easy.

What is claimed is:

1. A gearless traction-type elevator hoist apparatus with an outer rotor motor comprising:

a support structure;

a sheave rotatably mounted on said support structure; and an electric motor mounted on said support structure for driving said sheave, said motor comprising a stator fixedly mounted on said support structure, a motor housing including a cylindrical wall surrounding said stator and opposing sidewalls attached to said cylindrical wall, said sheave being mounted to one of said sidewalls for rotation with said housing, said housing comprising a rotor in an electromagnetically inductive relationship with said stator, said sheave providing the sole support for said motor housing.

2. An elevator hoist apparatus as claimed in claim 1 wherein said support structure comprises a pair of pedestals and an elongated support member supported at its opposite ends by said pedestals, said sheave and said stator being supported by said elongated support member.

3. An elevator hoist apparatus as claimed in claim 1 wherein said motor housing has an opening in at least one of said sidewalls for the passage of air therethrough.

* * * * *